US005928006A

United States Patent [19]

Franks, Jr.

[11] Patent Number: 5,928,006

[45] **Date of Patent: *Jul. 27, 1999**

[54] CLAMPING BRACKET FOR A GROUNDING SYSTEM

[76] Inventor: George J. Franks, Jr., 664 Thompson Cir., Inverness, Ill. 60067

[ * ] Notice: This patent is subject to a terminal disclaimer.

[21] Appl. No.: 08/933,311

[22] Filed: Sep. 18, 1997

Related U.S. Application Data

[63] Continuation-in-part of application No. 08/777,839, Dec. 26, 1996, Pat. No. 5,746,609.

[51] Int. Cl.[6] ..... H01R 4/66

[52] U.S. Cl. ..... 439/92; 439/443; 439/803

[58] Field of Search ..... 439/92, 443, 803, 439/813

[56] References Cited

U.S. PATENT DOCUMENTS

| | | | |
|---|---|---|---|
| 2,970,287 | 1/1961 | Gill | 439/92 |
| 3,528,050 | 9/1970 | Hindenburg | 439/92 |
| 4,322,773 | 3/1982 | Bordner . | |
| 4,828,504 | 5/1989 | Franks, Jr. | 439/92 |
| 4,884,976 | 12/1989 | Franks, Jr. | 439/92 |
| 4,993,960 | 2/1991 | Franks, Jr. | 439/92 |
| 5,006,074 | 4/1991 | Franks, Jr. | 439/92 |
| 5,114,354 | 5/1992 | Franks, Jr. | 439/92 |

OTHER PUBLICATIONS

Sachs bonding connectors SC51–1, SC51–2, SC51–3 and application procedures, 1992.

Sachs bonding connector SC51–CF, 1995.

*Primary Examiner*—Gary F. Paumen

*Attorney, Agent, or Firm*—Ronald L. Wanke; Jenner & Block

[57] ABSTRACT

A clamping bracket connects an electrical wire to a lip of a grounded utility box so as to ground the wire. The bracket has U-shaped portions and a threaded stud which moves an annular abrading end surface with a center cone point into engagement with the metal plate lip when located between the U-shaped portions. The rear planar member of the U-shape is formed by a leaf spring which slants inwardly and bends rearwardly until the leaf spring is approximately parallel with the front planar member due to engagement of a stop surface on the stud with the front planar member. A plurality of barbs located on the leaf spring assist to prevent inadvertent movement during tightening. The front planar member of the U-shape has side ribs which strengths the front planar member and space a threaded bore from the metal plate lip.

17 Claims, 1 Drawing Sheet

CLAMPING BRACKET FOR A GROUNDING SYSTEM

CROSS-REFERENCE TO RELATED APPLICATION

This application is a continuation-in-part of my application Ser. No. 08/777,839 filed on Dec. 26, 1996, now U.S. Pat. No. 5,746,609 issued May 5, 1998.

FIELD OF THE INVENTION

The present invention relates to a clamping bracket for mechanical and electrical connection to a metal plate, and has particular utility for connecting a grounded metal utility box to an electrical wire which is to be grounded through the utility box.

BACKGROUND OF THE INVENTION

Various clamping devices are known for providing an electrical and mechanical connection from an electrical wire to a metal plate such as a utility box which is separately connected to ground. For example, the utility meter box for an electrical power system, a telephone interface utility box, and a cable television (CATV) box may each be grounded by an elongated ground rod sunk into the ground and connected through heavy gauge wire to the utility box. Typical utility boxes are painted and/or treated with a coating to prevent rusting and to provide a long term life. Drilling a hole through a metal wall of the utility box is highly undesirable in that it may allow foreign matter and moisture into the box, can create a safety problem due to high voltage, can allow corrosion of the metal, and/or may be contrary to local codes.

Numerous clamping devices have been devised to connect a grounded utility box to a separate electrical conductor which is to be grounded so as to eliminate the need for an additional grounding system. Examples of such clamping devices are shown in U.S. Pat. Nos. 4,993,960 and 5,006,074 of the present applicant. Each of these patents show elongated clamps which span a metal utility box which is grounded in order to mechanically and electrically connect the utility box to an electrical wire coupled to other devices which are to be electrically grounded such as a telephone system, a cable TV system or the like. In certain situations, the elongated clamps which span across a utility box are not usable such as when several utility boxes are ganged together or are flush mounted panels. In addition, it is desirable to provide a clamping bracket which is less expensive to manufacture and has utility for a variety of grounding purposes.

Several U-shaped clamping devices, corner brackets and the like are known which are secured to a lip or corner of a utility box in order to couple an electrical wire to the grounded utility box. Generally, such prior art devices have consisted of one or more screws which clamp the device to the utility box, and an additional screw which couples the device to an electrical wire which is to be grounded through the utility box. Typical prior art devices of this type suffer from a variety of problems which have prevented more widespread use. As one or more screws on the device are tightened against a lip or corner of a utility box, continuing tightening can cause the device to "walk" or move across the utility box, causing difficulty in forming an adequate connection. Also, such devices can tilt or skew during tightening of multiple screws.

Because of various code requirements, there should be a separate screw for connecting an electrical wire to the clamping bracket in addition to any clamping screw(s) for connecting the bracket to the utility box. The one or more clamping screws for connecting the bracket to the utility box are tightened first. Then, an electrical wire is connected to the separate screw which is then tightened. This tightening of the separate screw can cause undesirable movement and/or loosening of the clamping screw(s) which have connected the device to the utility box.

To provide grounding protection, the clamping bracket must be able to withstand a fusion test in which high current is passed through the bracket for a predetermined time. Different users as well as standard setting bodies have different requirements. The clamping bracket when mounted to a meter box and serving as a ground connector must survive certain current surges to the extent that a #6AWG solid copper wire connected to the clamp and through which the current is passing will fuse before the integrity of the clamp is compromised. As one example, the bracket should withstand 1,000 amperes for 20 seconds or until the #6 wire fuses (melts and/or breaks open). As another example, 1,530 amperes may be passed for six seconds through the bracket for a total of six times during which the bracket cannot melt, crack or break. A number of prior art brackets are not able to pass such fusion tests and thus are inappropriate for grounding protection against current surges such as caused by lightning.

Other U-shaped clamping devices are known for securing an electrical wire to a metal plate for grounding purposes or the like. For example, U.S. Pat. Nos. 4,828,504 and 4,884,976 of the present applicant each show U-shaped clamps which can connect an electrical wire through a threaded stud having an abrading annular end surface to a metal plate. However, the thickness of the uprights forming the U-shaped clamp prevents the use of such a device when limited space is available. For example, a utility box may include a lip which overhangs a wall and only a narrow space is available for the clamping bracket. Such a narrow space will allow only a thin metal piece to be inserted into the gap to serve as a brace for the bracket.

Because of adverse weather conditions, it is very important for the clamping device to be rugged, as well as capable of forming and maintaining over time a secure mechanical and electrical connection to the utility box. In addition, the clamping device should be inexpensively formed with minimum parts and be capable of simple installation. This combination of features has not been satisfactorily solved in prior clamping devices.

SUMMARY OF THE INVENTION

A unique clamping bracket is provided which is readily connectable to an overhanging lip of a utility box to provide a more secure connection than has been possible with a utility box having a limited and restricted clamping area. The clamping bracket has minimum parts and is capable of a simple installation. It minimizes undesired "walking" or movement of the clamping device while it is being secured. Furthermore, the separate connection of an electrical wire to the clamping bracket does not tend to loosen the bracket from its clamping connection to the utility box.

In accordance with one aspect of the invention, the clamping bracket is formed by generally U-shaped members which converge slightly towards each other and exhibit a spring action. The slanted clamping surfaces are resiliently deflectable relative to each other as tightening occurs of a threaded stud. The bracket is readily connectable to a lip of a utility box where there is minimum space between the lip and the utility box wall, and yet provides a relatively strong connection.

In accordance with another aspect of the invention, a rectangular plate is bent to form a generally U-shaped bracket for connection to a lip of a utility box. Side ribs extend rearwardly from the front plate to space the front surface containing a threaded bore a small distance away from the lip of the utility box. A single threaded stud extends through the threaded bore and is rotatable to advance into engagement with the lip for strong mechanical and electrical connection therewith. The side ribs create flanges which strengthen the bracket and allow sufficient torque on the threaded stud to penetrate the outer surface of the lip to form an adequate grounding connection.

A further aspect of the invention involves a generally U-shaped bracket having a thin rear brace which is bendable, either intentionally or due to the dimensions necessary for insertion into a limited space, and a threaded stud having a stop surface which engages the bracket when a utility box has been adequately clamped to prevent further bending of the thin rear brace to thereby prevent overtightening of the stud.

In addition, the simplicity of the bracket and its ease of attachment create a clamping device for a utility box having a very limited contacting area for the clamp. It can be attached readily by persons having no special training and without the need for special tools. The resulting unique clamping bracket is usable in a variety of grounding situations which have not previously been addressed in an adequate manner.

DETAILED DESCRIPTION OF A PREFERRED EMBODIMENT

Figure 1:
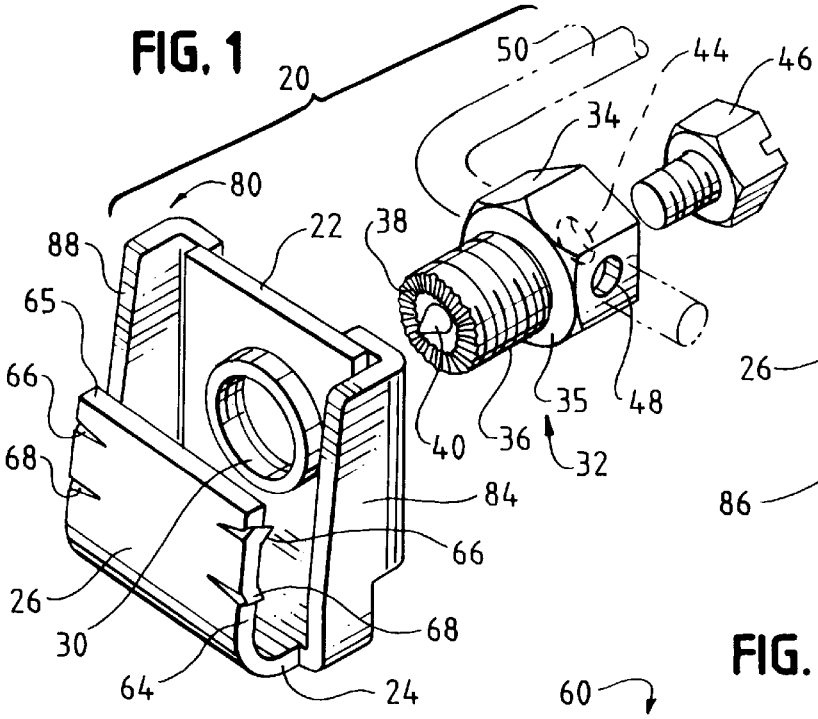
FIG. 1 is a perspective and exploded view (not to scale) of the novel clamping bracket.

Referring to FIG. 1, a novel clamping bracket 20 includes a generally rectangular metal plate which is bent into three sections to form a generally U-shaped member in which one side of the U is of greater length than the other side. Namely, the first longer section or side consists of a front planar member 22 which extends vertically upright from a second section of the general U-shape consisting of a base member 24 located at the bight or bottom of the U. A third shorter section consists of a rear or brace planar member 26 extending generally upwardly from the base member 24. The front and rear sections 22 and 26 are not parallel but incline together as will be explained. In the center of the front planar member 22, a threaded bore 30 extends axially through the front planar member and is located opposite the top edge region of the brace member 26. Preferably, the center axis of the bore 30 is located near the top region of the rear member 26, so that the rear member 26 extends slightly above the center axis.

The bracket 20 also includes a threaded stud or bolt 32 which has a hexagonal-shaped head 34 integrally formed on the bolt. The head 34 is enlarged and has an annular stop surface 35 from which protrudes a narrower threaded neck 36 which terminates in abrading annular end surface 38. The annular end 38 is in the form of an abrading rim, and the end has a concave interior with a center cone or point 40 which extends outwardly from the center of the neck 36. Center point 40 is generally cone-shaped and extends a short length past the end surface 38, as is described later in more detail.

The annular end 38 forms an abrading surface created by spaced grooves and ridges. Other penetrating end surfaces are usable including scoring or cutting or knife-like edges formed in the end of the neck. As will appear, the annular surface 38 is designed abrade the surface of the metal utility box so as to penetrate any paint or other coating or corrosion on the outside surface in order to form a secure mechanical as well as electrical connection with the utility box. The center point 40 serves to prevent inadvertent movement or "walking" of the bracket as it is being secured, as will be explained later.

Enlarged head 34 of the threaded bolt includes an interior threaded bore 44 coaxial with the axis of the threaded neck 36. The bore 44 receives an external threaded securing screw 46 which can be axially threaded into the bore 44. The head 34 also includes a cross bore 48 which extends through the head 34 and perpendicularly intersects the threaded bore 44. The cross bore 48 receives an electrical conductor or wire 50, shown in dashed lines, which can be inserted into the cross bore 48 when it is to be electrically coupled to the utility box in order to ground the wire 50.

Figure 4:
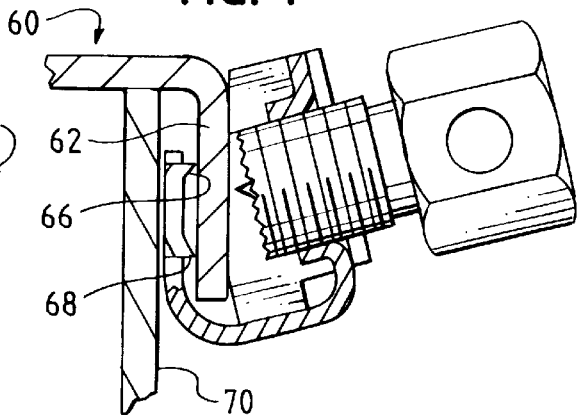
FIG. 4 is a side plan view, partly in section, of the clamping bracket including the threaded stud when initially engaging a lip of a utility box and illustrating a skewed manner of initial attachment of the clamping bracket to the utility box.
Figure 5:
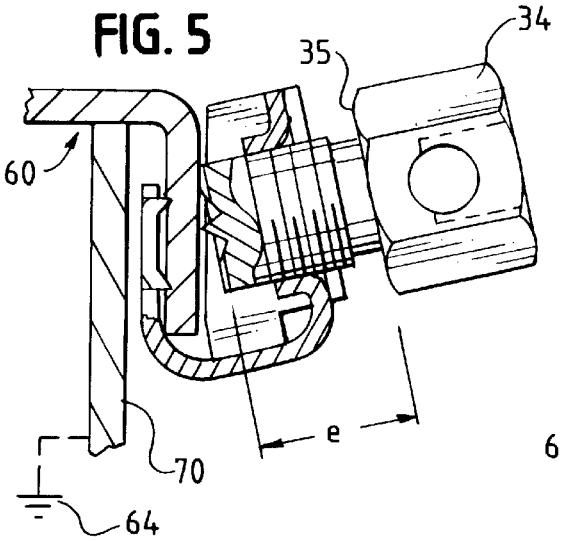
FIG. 5 is a side plan view, partly in section, of the clamping bracket including the threaded stud of FIG. 4 after limited rotation of the stud.
Figure 6:
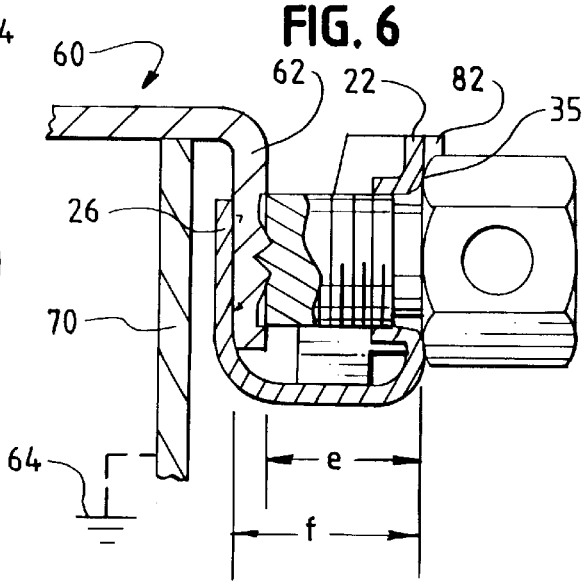
FIG. 6 is a side plan view, partly in section, of the bracket and utility box of FIGS. 4 and 5 and the manner in which movement changes the orientation of the clamping bracket during tightening onto the lip of the utility box until engaging a stop surface of the stud.

A metal utility box 60 is illustrated in FIGS. 4–6. Typically, an extending metal plate, such as a lip or skirt 62, extends from the utility box and provides a suitable surface for connecting the clamp bracket 20 to the utility box. Typically, the utility box itself is coupled to ground 64, as is illustrated in FIGS. 5 and 6, by means of a ground rod which is sunk into the ground and is coupled through a heavy electrical wire to the metal utility box. Examples of some grounded utility boxes are illustrated in my U.S. Pat. Nos. 4,993,960 and 5,006,074, the disclosures of which are hereby incorporated by reference herein. Such utility boxes can form an electrical power meter box, and/or a telephone interface box. In addition, the utility box can be in the form a flush mounted panel which is recessed into a building wall. Such utility boxes are typically painted or have other coatings covering the box for protection. Also, it is common for dirt and/or corrosion to form on the outside surfaces of the utility box. The clamping bracket 20 needs to form both a mechanical and a electrical connection to the metal interior of the utility box lip 62. This electrical connection can be for the purpose of connecting a telephone interface box to an electrical power box to avoid the necessity for another ground rod. Alternatively, the electrical wire 50 maybe coupled to a cable TV system which is to be grounded to a telephone utility box or to an electrical power utility box.

As seen best in FIG. 1, the rear planar surface 24 includes a plurality of projections or barbs which extend forwardly toward the front planar surface 22. The thin rear plate is generally rectangular with a pair of side edges 64 and a top edge 65 located above the center axis of the threaded bore 30. A pair of upper barbs 66 are formed in the side surfaces 64 and project forwardly toward the front planar member 22. A pair of lower barbs 68 are formed below the upper barbs 66 and also project forwardly toward the front planar member, as can be seen in FIGS. 4 and 5. These butterfly-shaped barbs 66, 68 can be formed by stamping the rear plate 26 to cause the material to project forwardly at the sides and towards the front planar member 22. The upper barbs 66 as well as the lower barbs 68 being located at the sides of the rear plate 24, are each spaced apart a maximum distance corresponding to the width of the rectangular rear plate 24.

To form a connection to the utility box, the bracket 20 is inserted over the lip 62 of the utility box so that the generally U-shaped space defined by the members 22, 24 and 26 surround the lip 62, as seen in FIGS. 4 and 5. The plurality of projecting barbs 66, 68 initially space the interior side of the lip 62 away from the remainder of the rear planar member 26, as is best seen in FIG. 4. Then, the threaded bolt 32 is rotated within the threaded bore 30 so as to advance the neck end surface into abutment with the lip 62. The projecting point 40 will penetrate the outer surface of the lip 62 at about the same time that the abrading rim engages the lip 62, as will be explained later. The projecting barbs 66, 68 as well as the projecting point 40 serve to prevent inadvertent movement or "walking" of the bracket 20 as it is being secured. As rotation of the bolt 32 continues such as with a wrench over the head 34, the abrading end surface 38 grinds through the coating or paint of the outer surface of the utility box lip and into intimate electrical and mechanical connection with the lip.

After the threaded bolt 34 is secured as seen in FIG. 6, the electrical conductor wire 50 is inserted into the cross bore 48. Then, the securing screw 46 is tightened into the threaded bore 44 to snugly engage the electrical wire 50. Because the threaded bore 44 is coaxial with the threaded bore 30, continued rotation of the securing screw 46 continues to tighten the bolt 32 against the lip 62, and thus prevents inadvertent loosening of the connection.

Many utility boxes have a lip 62 which closely overhangs a wall and this can greatly restrict the space available for connection of the bracket. For example, a wall 70 is often located closely adjacent the lip 62 and provides a very narrow and restricted gap between the lip 62 and the wall 70. This wall 70 can interfere with the brace member 26. The clamping bracket 20 is construed in a manner which allow the bracket to be utilized in such restricted spaces.

Figure 3:
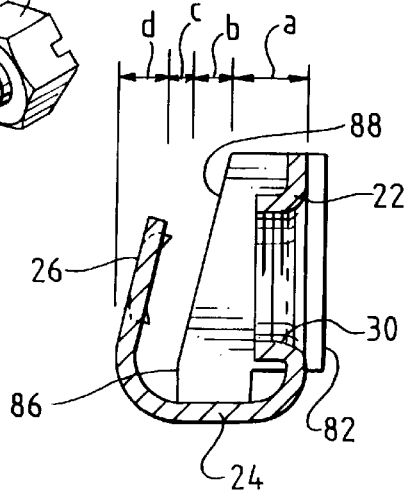
FIG. 3 is a side sectional view of the portion of the bracket of FIG. 2 taken along lines 3—3.

More particularly, the front planar member 22 and the brace planar member 26 slant towards each other as can be seen in FIG. 3. Thus, the planes of the planar members 22 and 26 are inclined toward each other and would intersect when projected upwardly. As a result, the axial distance between members 22 and 26 is shorter at the top opening of the U shape and is wider at the bottom of the bight adjacent the base member 24.

In a preferred form, the brace planar member 26 is a stiff leaf spring which is resiliently movable. When pressure is applied, it will deflect rearwardly and open or widen the top opening. As a result, the rear brace planar member 26 will move to a position generally parallel with the front planar member 22, as seen in FIG. 6. To create the leaf spring, the rectangular plate which is bent into the three sections 22, 24 and 26 is formed of CR spring steel material such as SAE 1074 which is heat treated to a hardness of 46 Rockwell C of suitable thickness, such as 0.048 inches thickness. While a bendable rear brace is preferable, the rear plate 26 can be fixed. Because the rear planar member 26 is thin in order to slide into a restricted space, it will flex or bend somewhat even if fixed relative to the front planar member 22 as the stud 32 engages the lip 62, given the dimensions of the large sized stud relative to the thin walls of the U-shaped bracket. Thus, references to front and rear planar members being relatively movable are intended to cover movement by action of a bendable brace as well as movement resulting due to the relative dimensions and materials utilized.

Figure 2:
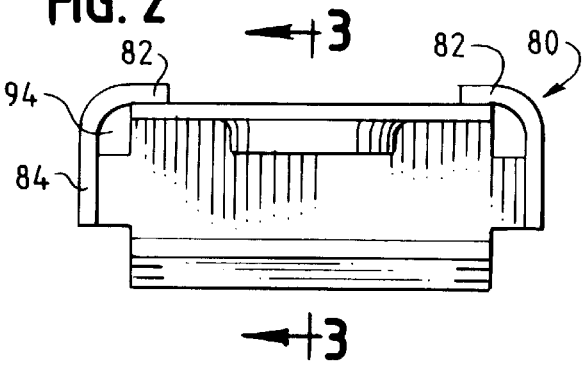
FIG. 2 is a top plan view of a portion of the clamping bracket shown in FIG. 1.

It is preferred that the front planar member 22 should remain rigid. A pair of side ribs or flanges 80 are spaced apart and located along each side of the front planar member 22, as seen best in FIGS. 1–3. Each side rib 80 is formed by a generally L-shaped flange having a front portion 82 extending in front of the planar surface 22, and a side rib 84 which extends rearwardly a greater distance than the thickness of the front planar member 22 and the threaded bore 30. The bottom of the flanges are welded to the base member 24 or, alternatively, may be formed by members bent upwardly and forwardly from a stamped plate. Each side rib 80 extends rearwardly to an edge rib surface 86 which is parallel to the front planar surface 22. At a transition point, the rear edge tapers into an angled edge 88 which is inclined at an angle to vertical. The axis of the angled edge 88 is generally parallel to the axis of the inwardly inclined brace planar surface 26, as can be seen in FIG. 3.

By way of example, the dimensions for one bracket 20 which was constructed are as follows. The overall vertical height of the bracket was about 0.727 inches and the overall width was about 1.25 inches from the sides of flanges 84. The approximate vertical height of the rear brace member 26 was about 0.55 inches. Certain depth dimensions labeled a, b, c and d are illustrated in FIG. 3. Depth a represents the distance from the front planar member 22 to the corner at which the angled edge 88 meets the top of the flange, and is on the order of 0.203 inches. The depth b is the maximum distance that the angled rear edge 88 is cut away from the vertical plane of the vertical rear edge 86 when projected upwardly, and is on the order of 0.128 inches. Thus, the distance a plus b from the front surface of the planar member 22 to the vertical rear edge 86 is on the order of 0.331 inches. The depth c extends from that point to the inside terminating end of the brace planar member 26 and is about 0.042 inches. Thus, a narrow gap in the axial direction exists at the top opening of the generally U-shaped space. The distance d extends from that point to the rear of the brace planar member and is about 0.083 inches. In FIG. 3, the inward slope of the rear spring leaf 26 can be seen with respect to these vertical reference lines. Of course, all dimensions are representative only and are not limiting.

The threaded bolt has a thick neck 36 with a ⅜ inch diameter, i.e. 0.375 inches, and of 24 threads per inch on the exterior of the neck. Thus, the neck diameter is relatively large and is preferably the same or greater than the axial opening of the gap which receives the lip. Such dimensions insure that the annual rim 38 grinds a large swipe or periphery area of the front planar member to create a better electrical contact while using only a single stud through the front plate 22 for mechanical clamping and electrical connection. Also, the size and dimensions of the threaded bolt are sufficient to pass a variety of electrical fusion tests and the resulting bracket is suitable for grounding protection. The enlarged head can have a 0.500 inch dimension and a hexagon shape for turning by a wrench. Interior bore 44 can be ¼ inch (0.250) with 20 internal threads per inch.

The thin material forming the front planar member 22, having a dimension such as 0.048 inches, can cause insufficient threaded surface in the bore 30 to adequately grip the threaded bolt 32 so as to allow adequate torque for tightening the bolt against the lip 62. The front member 22 can be extruded to create an annular extension 92 before the threads are formed in the bore in order to increase the depth of threaded surface area. The extension can have a thickness such as 0.085 inches, so that the total axial depth of the bore 30 is on the order of 0.133 inches with a ⅜ inch tap of 24 threads per inch so that three full threads minimum will hold the stud. This dimension is substantially less than the axial depth of the side ribs 84. Alternatively, the extension 92 could be formed by a washer welded to the rear of the front planar member 22.

The pair of side ribs 80 space the meter box lip 62 a distance or gap away from the threaded bore 30. As the threaded bolt 32 is rotated within the threaded bore 30, the bolt advances through the front planar member 22 and spans the gap created by the pair of side ribs 80, and then comes into contact with the utility box lip 62. The initial contact is by a combination of the center cone 40 and an upper region of the annular abrading surface 38, as seen in FIGS. 4 and 5 as will be explained below.

Each side rib 80 consists of an L-shaped section in which the front section 82 is located in front of the front planar member 22. As the threaded bolt is rotated and advanced into abutment, the utility box lip 62 presses against the plurality of projecting barbs 66, 68 on the brace member 26 which presents resistance to the threaded bolt. The threaded bolt 32 urges forwardly the front planar member 22. The front abutting surfaces 82 of the pair of side flanges 80 restrain forward movement of planar member 22 and serve to strengthen the overall U-shaped bracket. To further support the front planar member 22 against forward deflection, and increase the rigidly of the overall structure, the front planar member 22 can be soldered or welded 94 to the side ribs 80. The resulting bracket is very rigid while minimalizing the thickness of the plate material used in forming the bracket.

The tilt or skewed angle of the front planar member relative to the rear planar member is designed to minimize the clearance needed to insert the bracket over a thin lip such as in a surface mounted utility box where the spacing is minimal. The bracket 20 is initially tilted as shown in FIG. 4 and slips upwardly against the inner surface of lip 62. In this tilted orientation, the angled edge 88 is in sliding abutment with the outer vertical surface of the lip 62 and the plurality of projections 66, 68 are in sliding abutment with the inner vertical surface of the lip 62. As a result, the bracket can be inserted into a narrow gap in which the lip is just slightly spaced from the wall 70, and the gap is only slightly larger than the thickness of the brace member 26. In this tilted orientation, the center point 40 preferably contacts the lip 62 at the same time that the upper portion of the annular abrading surface 38 contacts the lip 62 as is seen in FIG. 5. As the threaded neck 36 further is rotated, the threaded bolt simultaneously digs into the lip 62 at the position of the center point and the upper abrading edge 38. The center point helps to prevent "walking" of the bracket as the upper annular abrading rim 38 simultaneously digs into the lip 62. Likewise, the plurality of butterfly barbs 66, 68 assist in preventing "walking" of the bracket as the stud is tightened. While the use of the projections 40, 66 and 68 are advantageous, one or more of them could be eliminated to reduce the cost of making the bracket 20, although some "walking" is liable to occur in certain situations.

As the threaded neck 36 continues to be rotated, more area of the annular abrading rim 38 will be urged into the lip 62. Also, the brace member 26 will deflect rearwardly and the bracket will assume a more vertical orientation until reaching the position illustrated in FIG. 6. At this time, the rear planar surface 26 is approximately parallel to the front planar surface 22. The stop surface 35 then abuts the front exterior of the planar surface 22 and prevents further tightening of the stud 32. At this time, the threaded bolt will have dug partly into the lip 62 sufficiently to have removed any paint or corrosion on the outer surface and thus will form a good electrical connection with the lip 62. This electrically grounds the stud to the utility box. Furthermore, the lip 62 is tightly clamped by the bracket 20 and this forms a sufficient mechanical connection. Further tightening is undesirable because the stud is sufficiently large relative to the thin rear planar member 26 that a continued rotation of the threaded neck would cause the rear planar member 26 to bend beyond the vertical position.

Thus, the length of the threaded neck, as illustrated by the distance "e" in FIGS. 5 and 6, is selected so that the stop surface 35 will abut the front planar member when the rear plate 26 is approximately parallel to the front planar member 22. The distance "f" in FIG. 6 from the stop surface to the rear plate 26 when upright is approximately the length of the neck e and the thickness of the lip 62. These dimensions need to accommodate a range of manufacturing tolerances as well as an allowance for tolerances for the thickness of the lip 62. Because of the accumulative effect of these tolerances, the rear wall 26 may be skewed forwardly or rearwardly with respect to the front plate 22 by a slight amount, but such variations are considered substantially parallel and are satisfactory so long as the abrading end surface has partly penetrated the outer surface of the lip 62 and the threaded bolt has not been advanced so far as to undesirably move rearwardly the rear planar member 26 to an extent which reduces the clamping effect. While the bracket preferably has a spring action, the advantageous effect of the stop surface 35 is useful even when the U-shaped bracket is not designed to flex but moves because of the relatively thin dimensions of the parts relative to the threaded stud. All such variations are intended to be within the teaching of the invention.

The angled rib edges 88 in effect represent "cut out" surfaces with respect to the vertical plane of the rib edges 86. This allows the bracket to be tilted against the lip 62 as seen in FIGS. 4 and 5. If the edges 86 were extended vertically to a top corner, then the top side of the side ribs would interfere with the tilting of the bracket when initially inserted over the lip 62. Thus, an increased angle of tilt is available.

Other modifications can be made without departing from the advantageous features of the present invention. For example, while the resilient connection between the front planar member 22 and the rear brace planer member 26 was accomplished by making the rear brace a flexible leaf spring, it will be apparent that the rear brace could be rigid with the front planar member 22 being flexible. Also, the rear brace member 26 could form a right angle with the bottom member 24, and the front planar member 22 could be slanted from vertical. Other modifications are within the spirit of the present invention.

What is claimed is:

1. A clamping bracket for mechanical and electrical connection to a metal plate, comprising:

a generally U-shaped plate having a front planar member containing a threaded bore, a base member at a bight section, and a rear planar member which is spaced from the front planar member to define a gap for containing the metal plate, the front and rear planar members being relatively movable with respect to each other to vary the distance of the gap, a threaded stud having a head and an extending neck with threads to rotatably engage the threaded bore for axial movement towards the rear planar member, the end of the neck having an abrading end surface movable into engagement with the metal plate to urge the metal plate against the rear planar surface and thereby vary the gap distance, the head having a stop surface which abuts the front planar member when the abrading end surface has penetrated an outer surface of the metal plate to prevent further relative motion between the front and rear planar members so that the rear planar member remains approximately parallel to the front planar member, whereby the metal plate is electrically connected to and mechanically clamped by the stud.

2. The clamping bracket of claim 1 wherein the front planar member and the rear planar member are slanted towards each other and are relatively bendable as the threaded stud urges the metal plate against the rear planar member.

3. The clamping bracket of claim 2 wherein the head is enlarged and a reduced diameter neck extends from the head to the abrading end surface, and means for securing an electrical wire to the enlarged head to thereby electrically connect the electrical wire to the metal plate.

4. The clamping bracket of claim 3 wherein the securing means comprises a cross bore extending through the head for receiving the electrical wire therein, a threaded head bore extending from a surface of the enlarged head to intersect the cross bore, and a screw securable within the threaded head bore and rotatable for abutment against the electrical connector when located within the cross bore.

5. The clamping bracket of claim 1 wherein the front planar member has only a single threaded bore located therein, and the threaded stud forms the sole element which is movable from the front planar member and into engagement with the metal plate whereby the stud clamps the generally U-shaped plate against the metal plate and electrically connects the stud to the metal plate.

6. The clamping bracket of claim 5 wherein the extending neck of the threaded stud has a diameter which is on the same order as or greater than the distance of the gap.

7. The clamping bracket of claim 1 wherein the end of the neck has an annular rim which creates the abrading end surface and which surrounds a center point which projects outwardly from the surrounding annular rim.

8. The clamping bracket of claim 1 wherein the rear planar member is formed by a spring leaf which extends upwardly from the base member and is bendable rearwardly away from the front planar member as the threaded stud is rotated to urge the metal plate against the rear leaf spring until the stop surface abuts the front planar member.

9. The clamping bracket of claim 1 including rib means extending between the front planar member and the base member to form a rigid connection therebetween while allowing the rear planar member to move relative to the braced front planar member.

10. A clamping bracket for mechanical and electrical connection to a metal plate, comprising:

a generally U-shaped plate having a front planar member containing a threaded bore, a base member at a bight section, and a rear planar member extending upwardly from the bight section and spaced from the front planar member to create a gap therebetween for containing the metal plate, a plurality of projections extending from the rear planar member into the gap and toward the front planar member, a threaded stud having a head and an extending neck with threads to rotatably engage the threaded bore for axial movement towards the rear planar member, the end of the neck having an abrading end surface movable into engagement with the metal plate to urge the metal plate against the plurality of projections on the rear planar surface and thereby clamp the metal plate as the abrading end surface penetrates an outer surface of the metal plate to electrically connect the stud to the metal plate;

wherein the rear planar member has a pair of side surfaces and a top surface therebetween which defines an opening for inserting the metal plate into the gap, and the plurality of projections include at least a first projection on one of the side surfaces and a second projection on the other of the side surfaces for engaging the metal plate at spaced locations which are approximately the width of the rear planar member.

11. The clamping bracket of claim 10 wherein the first and second projections are stamped into the rear planar member to create barbs formed from the rear planar member and which project into the gap.

12. The clamping bracket of claim 10 wherein the plurality of projections include at least a third projection on one of the side surfaces and a fourth projection on the other of the side surfaces, the third and fourth projections being spaced from the first and second projections respectively so as to space the metal plate from the remainder of the rear planar member as the outer surface of the metal plate is engaged by the abrading end surface.

13. The clamping bracket of claim 10 wherein the front and rear planar members are relatively movable with respect to each other to vary the distance of the gap, and the threaded stud includes a stop surface which abuts the front planar member when the abrading end surface has penetrated the outer surface of the metal plate to prevent overtightening of the threaded stud.

14. The clamping bracket of claim 13 wherein the front planar member and the rear planar member are slanted towards each other and are relatively bendable as the threaded stud urges the metal plate against the rear planar member, and the stop surface abuts the front planar member when the front and rear planar members are approximately parallel to each other.

15. The clamping bracket of claim 10 wherein the rear planar member is formed by a spring leaf which extends upwardly from the base member and is bendable rearwardly away from the planar member as the threaded stud is advanced to urge the metal plate against the rear leaf spring, whereby the plurality of projections prevent inadvertent movement of the leaf spring with respect to the metal plate.

16. The clamping bracket of claim 15 wherein the generally U-shaped plate includes a pair of side flanges extending upwardly from the bight section and each having a section in front of the front planar member to stiffen the front planar member against forward deflection as the stud urges the metal plate against the rear leaf spring.

17. The clamping bracket of claim 15 wherein the extending neck of the threaded stud has a diameter which is on the same order as or greater than the distance of the gap.

* * * * *